US008205850B2

(12) United States Patent
Opresnik

(10) Patent No.: US 8,205,850 B2
(45) **Date of Patent: *Jun. 26, 2012**

(54) HANDS-FREE READING DEVICE

(76) Inventor: Cindy Jane Opresnik, Boxhill (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/238,896

(22) Filed: Sep. 21, 2011

(65) Prior Publication Data

US 2012/0032061 A1 Feb. 9, 2012

Related U.S. Application Data

(63) Continuation of application No. 12/799,738, filed on Apr. 29, 2010, now Pat. No. 8,083,200, which is a continuation of application No. 12/221,986, filed on Aug. 8, 2008, now abandoned, which is a continuation of application No. 10/566,137, filed as application No. PCT/AU03/00952 on Jul. 30, 2003, now abandoned.

(51) Int. Cl.
*A47B 23/00* (2006.01)

(52) U.S. Cl. ..... 248/441.1; 248/450

(58) Field of Classification Search ..... 248/441.1, 248/444, 445, 450, 451; 5/636, 545; 281/45; 462/71

See application file for complete search history.

(56) References Cited

U.S. PATENT DOCUMENTS

| | | | | |
|---|---|---|---|---|
| 1,928,806 | A | 10/1933 | Barcalo | |
| 1,934,254 | A | 11/1933 | Barcalo | |
| 3,400,413 | A | 9/1968 | La Grossa | |
| 4,011,611 | A | 3/1977 | Lederman | 5/361 B |
| 4,109,960 | A | 8/1978 | Stinchfield | 297/258 |
| 4,967,992 | A | 11/1990 | Menaged | 248/454 |
| 4,978,096 | A | 12/1990 | Struckmann | 248/451 |
| 5,941,599 | A | 8/1999 | Roberts | 297/115 |
| 6,044,758 | A | 4/2000 | Drake | 100/43 |
| 6,073,288 | A | 6/2000 | Berenstein | 5/636 |
| 6,270,050 | B1 | 8/2001 | Friedrich | 248/444 |
| 6,434,770 | B2 | 8/2002 | Matthews Brown | 5/636 |
| 6,820,850 | B2 | 11/2004 | Coleman | 248/346.07 |
| 6,820,852 | B2 | 11/2004 | Wainscott et al. | 248/444.1 |
| 2002/0184709 | A1 | 12/2002 | Berry, IV | 5/655.4 |

FOREIGN PATENT DOCUMENTS

| | | | |
|---|---|---|---|
| FR | 2 424 004 | A1 | 11/1979 |
| GB | 2 059 758 | A | 4/1981 |

*Primary Examiner* — Ramon Ramirez

(74) *Attorney, Agent, or Firm* — Seed IP Law Group PLLC

(57) ABSTRACT

The disclosed hands-free reading device is a particle filled bag having an alcove to support a book or other item comprising readable text in a hands-free reading position. A method of arranging an item for the purposes of reading is also provided.

19 Claims, 3 Drawing Sheets

HANDS-FREE READING DEVICE

CROSS-REFERENCE TO RELATED APPLICATION

This application is a continuation of U.S. patent application Ser. No. 12/799,738, filed Apr. 29, 2010, which is a continuation of U.S. patent application Ser. No. 12/221,986, filed Aug. 8, 2008, now abandoned, which is a continuation of U.S. patent application Ser. No. 10/566,137, filed on Feb. 5, 2007, now abandoned, which is a U.S. National Phase Application under 35 U.S.C.§371 of International Application No. PCT/AU2003/000952, filed on Jul. 30, 2003, where these applications are incorporated herein by reference in their entireties.

BACKGROUND

1. Technical Field

This disclosure is related to hands-free reading devices, including in particular, book rests.

2. Description of the Related Art

Books and other items comprising readable text are typically held in a reader's hands when reading; however, a reader's hands or arms may become fatigued when reading in this manner for extended periods of time.

BRIEF SUMMARY

According to one embodiment, a book rest may be summarized as including a bag filled with particle matter and an insert structure attached to the bag and defining an alcove to hold a book in a hands-free reading position. The alcove may be configured to receive the book in a generally upright position. The insert structure may include a first section which supports a bottom of the book when the book is supported by the book rest and other sections which support a front and a back of the book when the book is supported by the book rest. Sections of the insert structure may be flat. The insert structure may comprise a plurality of inserts. The particle matter in the bag may comprise foam beads or beans. The bag may be made of a flexible and pliable material, such as, for example, PVC, vinyl or cloth (including woven fabric). The book rest may further include an adjustable page holder to hold the book open. The adjustable page holder may be made of wood, fiber glass, carbon fiber or plastic materials, such as, for example, Perspex™. The page holder may be held in position by a toggle threaded onto elastic which enables the page holder to slide up the elastic to press firmly against the book. Sections or portions of the page holder may slide under the edges of the book, thus ensuring the page holder presses firmly against the pages of the book to keep the book open.

A method of arranging an item for the purposes of reading from the item may be summarized as including: providing a bag filled with particle matter and positioning the item such that the item is held by an alcove in the bag to be supported in a hands-free reading position. Positioning the item may include positioning a book such that the book is held by the alcove in the hands-free reading position. The particle matter may comprise foam beads or beans. The bag may be made of a flexible and pliable material, such as, for example, PVC, vinyl or cloth (including woven fabric).

BRIEF DESCRIPTION OF THE SEVERAL VIEWS OF THE DRAWINGS

The invention may be better understood with reference to the illustrations of embodiments of the invention in which.

DETAILED DESCRIPTION

Figure 1:
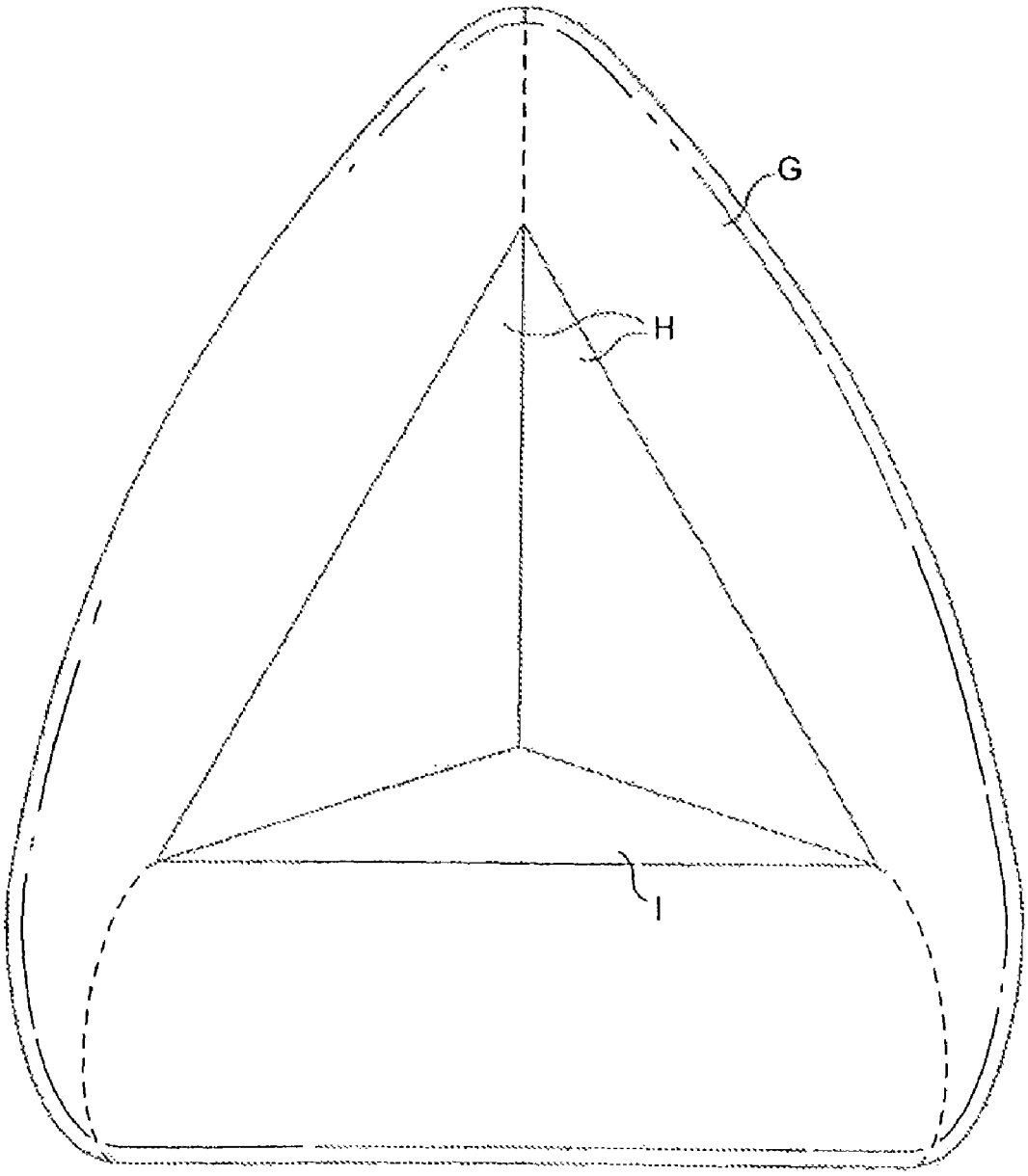
FIG. 1 is a front perspective view of a hands-free reading device, according to one embodiment, having inserts on which a book or other item comprising readable text may be supported.

The hands-free reading device which is shown in FIG. 1 includes a bag (G) made of a flexible and pliable material, such as, for example, PVC, vinyl or cloth (including woven fabric). The bag (G) contains a suitable particle matter such as foam beads, balls or beans, which enable the flexibility needed to adjust the position of the hands-free reading device and sit the hands-free reading device comfortably on any surface. The bottom of a reader's book or other item comprising readable text may then sit on an insert (I) of the device, as shown in FIG. 3, while leaning on other inserts (H). The inserts (I), (H) may be flat sections that combine to define an alcove for the book or other item comprising readable text, as shown in FIGS. 1 through 3.

Figure 2:
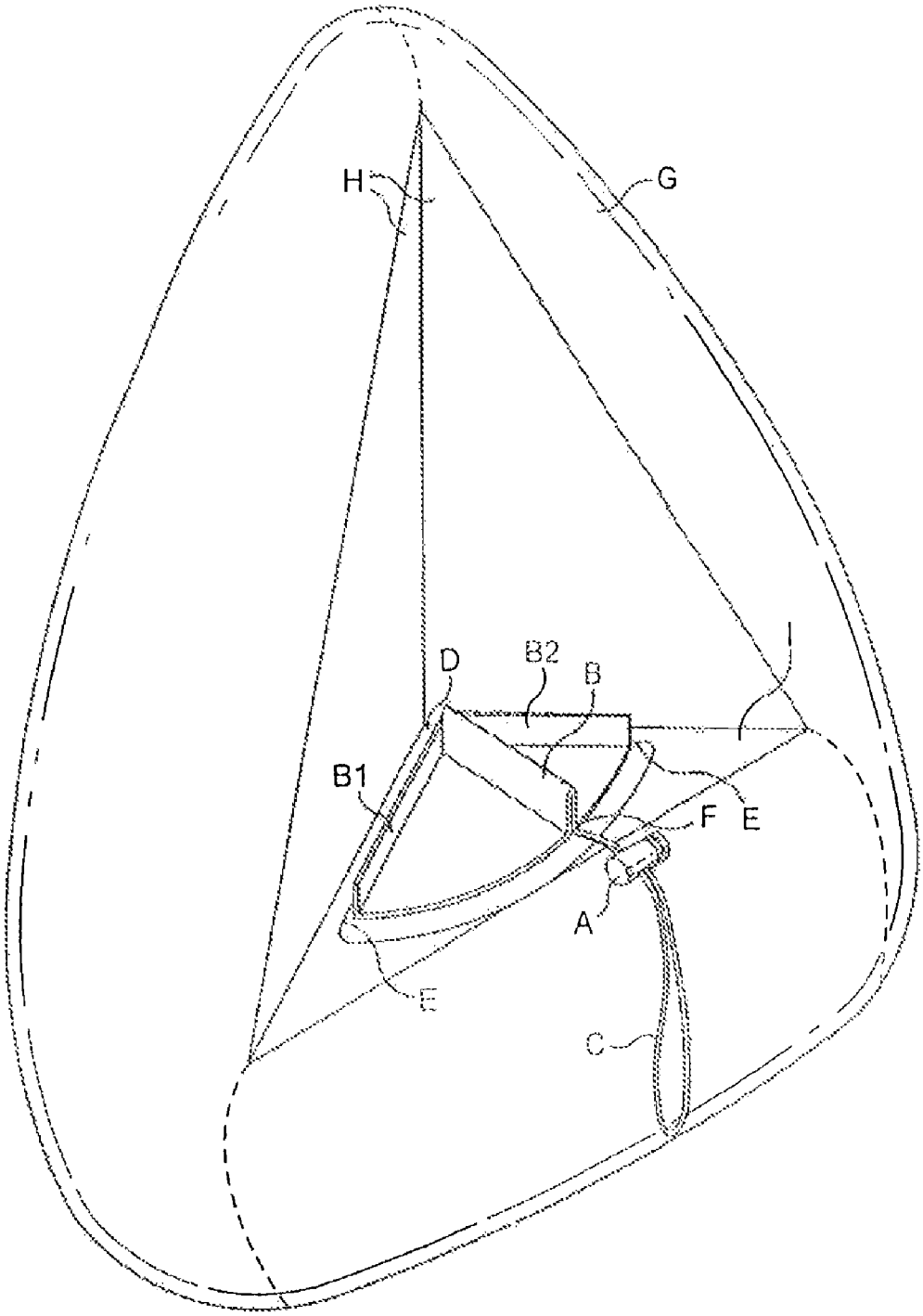
FIG. 2 is another perspective view of the hands-free reading device of FIG. 1 with a page holder.
Figure 3:
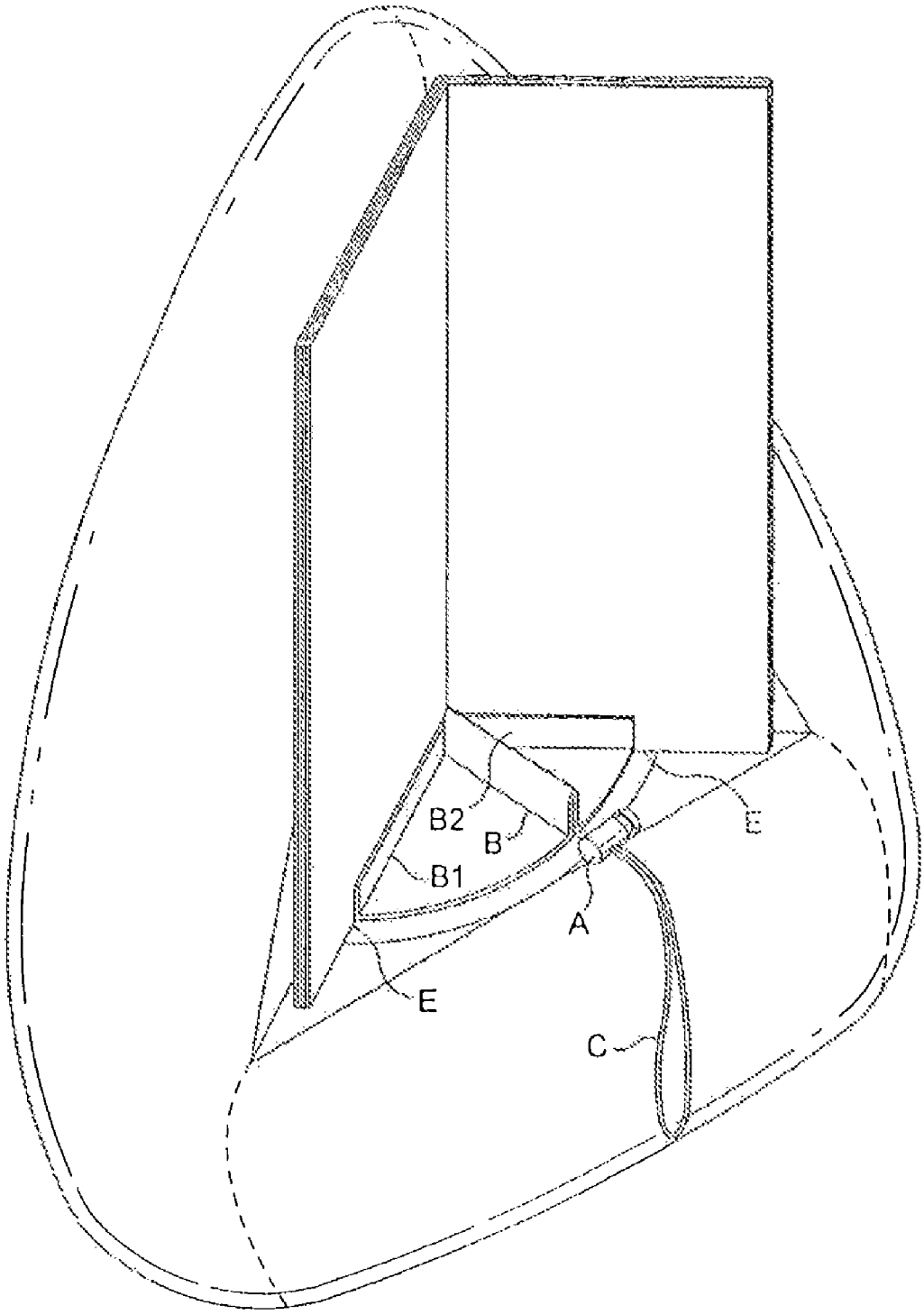
FIG. 3 is another perspective view of the hands-free reading device of FIG. 1 with a page holder holding a book in an open position.

FIG. 2 shows a page holder (B) received on the insert (I) of the hands-free reading device to hold a book. The page holder (B) may be made of plastic, such as a Perspex™ material, or a plastic like material. The adjustable page holder may also be made of wood, fiber glass or carbon fiber.

As shown in FIG. 2, elastic (C) can be threaded through a hole (F) in the page holder (B) and attached to the hands-free reading device at point (D). A toggle (A) can move along the elastic (C) for easy adjustment of the page holder (B). Page holder edges (E) can slide under each side of a book to keep it in place, as shown in FIG. 3.

FIG. 3 shows a book in an open position, resting on the hands-free reading device. To ensure that the pages don't move, and that the reader can indeed read hands-free, the page holder edges (E) can slide under the edges of the book to allow parts (B1) and (B2) of the page holder (B) to press firmly against the pages of the book. The toggle (A) enables a reader to slide up the toggle (A) and tension the elastic (C), to pull and hold the page holder (B) in position against the book. The page holder (B) can also be slid towards the reader and away from the book, whilst still under some tension from the elastic (C).

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A method of arranging an item for the purposes of reading from the item, the method comprising:

providing a bag filled with particle matter; and positioning the item such that the item is received by a recess in the bag to rest in a hands-free reading position.

2. The method according to claim 1, wherein the particle matter comprises foam beads.

3. The method according to claim 1, wherein the particle matter comprises beans.

4. The method according to claim 1, wherein positioning the item includes positioning a book such that the book is received by the recess to rest in the hands-free reading position.

5. A method of arranging a book for the purposes of reading the book, the method comprising:

providing a bag filled with particle matter; and positioning the book such that the book is received by a recess in the bag to rest in a hands-free reading position.

6. The method according to claim 5, wherein the particle matter comprises foam beads.

7. The method according to claim 5, wherein the particle matter comprises beans.

8. A combination comprising:

a bag filled with particle matter; and an item received by a recess in the bag such that the item rests in a hands-free reading position.

9. The combination of claim 8, wherein the item comprises a book.

10. A book rest comprising:

a bag filled with particle matter; and an insert structure attached to the bag and defining an alcove to hold a book in a hands-free reading position, the insert structure including a first section which supports a bottom of the book when the book is supported by the book rest and other sections which support a front and a back of the book when the book is supported by the book rest.

11. The book rest according to claim 10, wherein the sections of the insert structure are flat.

12. The book rest according to claim 10, wherein the insert structure comprises a plurality of inserts.

13. The book rest according to claim 10, further comprising:

an adjustable page holder configured to hold the book open when the book is supported by the book rest so as to enable a user hands-free reading.

14. The book rest according to claim 10, wherein the alcove is configured to receive the book in a generally upright position.

15. The book rest according to claim 10, further comprising:

a page holder configured to press the book open against the alcove when the book is supported by the book rest so as to enable a user hands-free reading.

16. The book rest according to claim 15, further comprising:

elastic coupling the page holder to the bag; and a toggle coupled to the elastic for selectively adjusting an amount of force that the page holder applies to the book when the book is supported by the book rest.

17. A book rest according to claim 15, wherein a force applied to the book by the page holder is adjustable.

18. A book rest for supporting a book in a hands-free reading position, the book rest comprising:

a pliable bag filled with particle matter which conforms to a support surface; and at least one insert coupled to the pliable bag to define a recess arranged to receive the book when the pliable bag is positioned on the support surface such that the book rests in the hands-free reading position.

19. The book rest of claim 18, further comprising:

an adjustable page holder configured to hold the book open when the book is supported by the book rest.

* * * * *